US006113088A

United States Patent [19]

Gakhar et al.

[11] Patent Number: 6,113,088

[45] Date of Patent: Sep. 5, 2000

[54] ADJUSTABLE WORKBENCH HAVING QUICK ACTION CLAMPS

[75] Inventors: Ved P. Gakhar; W. Miles Hale; Donald M. Szymanski, all of Louisville, Ky.

[73] Assignee: Vermont American Corporation, Louisville, Ky.

[21] Appl. No.: 09/187,338

[22] Filed: Nov. 6, 1998

[51] Int. Cl.[7] ..... B25B 1/02

[52] U.S. Cl. ..... 269/139; 269/145; 269/220; 269/901

[58] Field of Search ..... 269/139, 141, 269/145, 220, 901, 138, 219, 91, 93, 94

[56] References Cited

U.S. PATENT DOCUMENTS

| | | | |
|---|---|---|---|
| 2,351,436 | 6/1944 | Ketz | 269/94 |
| 3,712,606 | 1/1973 | Cole | 269/93 |
| 4,154,435 | 5/1979 | Alessio . | |
| 4,248,411 | 2/1981 | Wagster et al. . | |
| 4,265,436 | 5/1981 | Wagster et al. . | |
| 4,278,243 | 7/1981 | Alessio | 269/16 |
| 4,352,489 | 10/1982 | Wagster | 269/139 |
| 4,378,107 | 3/1983 | Wagster et al. . | |
| 4,442,779 | 4/1984 | Basten et al. . | |
| 4,470,586 | 9/1984 | Spencer | 269/93 |
| 4,958,813 | 9/1990 | Dykstra | 269/94 |
| 5,275,391 | 1/1994 | Lynn et al. | 269/93 |
| 5,681,034 | 10/1997 | Noniewicz . | |
| 5,692,734 | 12/1997 | Aldredge, Sr. . | |
| 5,836,574 | 11/1998 | Park | 269/93 |

*Primary Examiner*—James G. Smith
*Assistant Examiner*—Lee Wilson
*Attorney, Agent, or Firm*—McDermott, Will & Emery

[57] ABSTRACT

In order to enable quick and easy clamping of a work piece or device to the top of a work bench, the work bench is formed with a plurality of keyhole-like slots which are adapted to receive a threaded shaft and stopper arrangement which extends down from each of a plurality of rocker arm-like clamp members. Each of these clamps is such that a stopper which is provided on the bottom of the threaded shafts, is wider than the width of the slot. Rocker arms, which are connected to the upper ends of the threaded shaft, are each provided with a vertically extending bore through which a threaded shaft extends, and an intersecting lateral bore in which a follower nut which cooperates with the threaded shaft, is received. The lateral bore is formed toward one end of the rocker arm that is adapted to have engagement fingers or members at each end. The follower nuts are each formed with a thread only on one side of the bore through which the threaded shaft is disposed and are each arranged to laterally displaceable so that temporary disengagement between the threads can be achieved to allow for quick setting of the clamps.

49 Claims, 8 Drawing Sheets

ADJUSTABLE WORKBENCH HAVING QUICK ACTION CLAMPS

BACKGROUND OF THE INVENTION

1. Field of the Invention

The present invention relates to a multi-task, adjustable workbench which provides a stable and versatile work platform for a variety of work functions. More particularly, the present invention relates to a workbench which can be selectively widened and which is provided with a plurality of slots which allow quick acting rocker arm-like clamps to be selectively moved to desired positions and quickly used to secure a work piece or the like, in place.

2. Description of the Related Art

Various workbench arrangements have been proposed. One example of a foldable workbench is disclosed in U.S. Pat. No. 4,278,243 issued on Jul. 14, 1981, in the name of Alessio. This arrangement features a foldable stand upon which two benchboards are supported. One of these boards is arranged to be movable with respect to the other, and is slidable supported on rails that are in turn operatively connected with a pair of drive shaft and follower nut arrangements. The drive shafts in this arrangement are connected to a pair of crank handles via which an operator can selectively move the bench boards toward and away from each other in manner to accommodate different sized work pieces. Each of the bench boards is formed with a pattern of bores into which stopper-like members can be selectively disposed and used to secure a work piece in a desired position.

This arrangement, however, has suffered from the drawback that it is often required to use C clamps to secure a large work piece and/or piece of apparatus such as a vice, drill, miter saw, or the like.

An additional drawback which is encountered with this type of relatively simple work bench arrangement, resides in that it is relatively difficult to secure pieces of large diameter pipe or an oddly shaped work piece in position for cutting and/or machining. One example that is directed to overcoming this problem is disclosed in U.S. Pat. No. 4,154,435, issued on May 15, 1979, in the name of Alessio. This arrangement features the use of two bench type members, one of which is arranged to be inclined with respect to the horizontal, and thus achieve a v-shaped support surface upon which articles such as large diameter pipe can be disposed and clamped.

Nevertheless, this arrangement also tends to be less stable than desired, and becomes relatively complex and expensive.

SUMMARY OF THE INVENTION

It is an object of the present invention to provide a workbench arrangement which is both relatively simple and stable, and which enables various types of work pieces to be quickly and readily clamped in position ready for cutting and/or the like type of operation.

It is a further object of the present invention to provide a workbench which is equipped with quick acting clamps which can be quickly moved about the workbench and quickly applied and tightened to clamp a work piece in a desired position.

It is yet another object of the present invention to provide a workbench wherein rocker arm-like clamps are used to provide quick and ready clamping of a workpiece in a given position.

Yet another object of the invention is to provide rocker arm-like clamps for use on a workbench wherein the tilting action of the clamps enables various types of variously shaped work pieces to be quickly set and clamped in position.

It is still a further object of the present invention to provide rocker arm-like clamps for use on a work bench, and which are provided with quick acting arrangements wherein a screw thread which is used to tighten the clamps in position, can be temporarily disengaged from the follower nut which is associated therewith, and thus permit very rapid setting of the clamps in the desired position, and very rapid tightening of the clamps with the minimum amount of screw thread rotation being required by the operator.

In brief, the above and other objects of the present invention are achieved by a workbench that features a pair of bench boards which are selectively separable and which are formed with a plurality of slots. These slots are adapted to receive one or more rocker arm-like clamp arrangements, which are tiltable so that one end acts as a reaction member and the other acts as a clamping member which actually engages the work piece that is set on the workbench.

In fact, the rocker arm-like clamp arrangements have such utility that they can be applied to workbenches wherein the ability to separate two or more pieces thereof, is absent, and wherein the bench top is simply formed with minimal apertures and/or slots to permit the clamps to be applied and used to hold a work piece in a given position.

More specifically, a first aspect of the invention resides in an apparatus which features: a clamp which comprises: a body having first and second ends and first and second engagement portions formed respectively at the first and second ends, the first engagement portion being angled with respect to a longitudinal axis of the body at a first angle and the second engagement portion being angled with respect to the longitudinal axis at a second angle which is different from the first angle; a first bore formed transversely through the body portion, the bore being formed so as to be located so as to be closer to the first end of the body than the second end, the first bore having a first axis; a second bore formed vertically through the body, the second bore being formed so as to intersect the first bore; a threaded bolt disposed through the second bore; a cylindrical nut disposed in the first bore, the cylindrical nut having a third bore formed therein through which the threaded bolt extends, the bore having a half thread formed on a first portion of its inner periphery and a smooth surface on a second diametrically opposite inner peripheral portion, the bore having a non-circular cross section so as to be oblong in the direction of the first axis, the cylindrical nut being axially displaceable in the first bore so as to be moved between a first position wherein engagement between the half thread formed on the first portion of the inner periphery of the third bore and a thread on the threaded bolt, engage, and a second position wherein the half thread formed in the third bore and the thread on the threaded bolt disengage; and a stopper member fastened to the bottom of the threaded bolt.

In the above, a first embodiment of the clamp features an arrangement wherein the first bore is a through bore and the cylindrical nut has first and second end surfaces which are exposed at the ends of the first bore so that it can be manually displaced between the first and second positions using thumb pressure of the like.

In a second embodiment of the clamp, the first bore is a blind bore and the cylindrical nut has first and second ends. A biasing means is disposed in the blind bore in a manner to engage a first end of the cylindrical nut and to bias the nut toward the first position, and the cylindrical nut has a flange at the second end thereof which has a diameter larger than a diameter of the first bore and an inner side wall which engages a side of the body. The distance from the inner wall to the half threads is selected such that when the cylindrical nut is manually displaced into the first bore against the bias of the biasing means, the inner wall of the flange engages the side of the body only after the half threads in the third bore have disengaged from the threads on the threaded bolt.

In accordance with this second embodiment of the clamp arrangement, locking means is provided for locking the cylindrical nut in its first position. This locking means comprises a pivotal member which can be interposed between the body and the flange and to engage the inner wall of the flange so that movement of the cylindrical nut into the first bore is prevented and the cylindrical nut is maintained in its first position.

The above-mentioned aspect of the invention further features a table that has at least a first slot formed therein. This first slot has a width that is less than the stopper, so that when the threaded bolt is disposed through the slot, the stopper member engages a lower surface of the table. The body of the clamp is, of course, located above an upper surface of the table and so that one of the first and second engagement portions is engageable with the upper surface of the table.

In order to permit quick and easy positional interchange, the above mentioned slot has an enlarged portion having a width greater than that of the stopper member and through which the stopper member can be inserted/withdrawn. In fact by placing the enlarged portion at the end of the slot a keyhole like configuration is formed.

The table used in this invention is such that it formed with first and second table portions which are supported on a support structure. The first table portion is arranged to be movable with respect to both the support structure and the second table portions, and is operatively connected with a drive mechanism to be selectively movable with respect to the other table portion.

It goes without saying that slots are, in accordance with the present invention, formed in both of the table portions and that these slots also have an enlarged portion to permit quick and easy relocation of a clamp or clamps.

The above mentioned support structure is such as to have two pairs of legs. Each leg of each pair of legs is pivotally connected to a cross member, and each pair of legs is interconnected by a brace. Each of the braces is pivotally connected at a first end to a first of the pair of legs at a first distance from the point at which the first leg is connected to a cross member, and pivotally connected at a second end to a second of the pair of legs at a second distance from the point at which the second leg is connected to the cross member, the second distance being greater than the first distance.

A second aspect of the invention resides in an apparatus which comprises:

a table supported on a support structure and which includes first and second table portions which are operatively interconnected by a drive mechanism so as to be movable relative to each other. Each of the table portions are formed with a plurality of keyhole-shaped slots having an elongate narrow portion and a wide portion at one end. This table further includes a plurality of clamp members which each have a stopper member at a lower end thereof, and which can be disposed through a wide portion of a slot and moved to a narrow portion so that the stopper member is engageable with a lower surface of the table portion in which the slot is formed, so that the clamp is restrained against vertical displacement.

In this arrangement the clamps and support structure feature a construction of a nature similar to that mentioned above.

A third aspect of the invention features an apparatus comprising: a rocker arm respectively pivotal about i) a laterally extending axis which is coincident with an axis of a first bore which is extends laterally through the rocker arm, and ii) a vertically extending axis which is coincident with an axis of a second bore which extends vertically through the rocker arm. The first and second ends of the rocker arm respectively have first and second engagement portions adapted to respectively engage first and second surfaces. This arrangement is further combined with means for producing a force which forces the first and second engagement portions into engagement with the first and second surfaces.

In the above, the force producing means comprises: a threaded bolt and a nut follower, the nut follower being disposed in the first bore and the threaded bolt being disposed through the second bore. A quick release means is incorporated into this arrangement for temporarily disengaging a drive connection between the threaded bolt and the nut follow and for allowing the rocker arm to be freely moved along the threaded bolt and to be rotated about the first and second axes to quickly achieve a desired disposition of the first and second engagement portions on first and second surfaces.

The above mentioned force producing means further comprises a stopper member which is rigidly connected to a lower end of the threaded bolt and which is adapted to engage a surface and to produce a reaction which causes the rocker arm to be drawn theretoward when the nut follower is in the first position and the threaded bolt is rotated in a direction which moves the nut follower along the threaded bolt toward the stopper member.

In more detail, the above mentioned quick release means comprises: a half thread arrangement formed in a third bore which is formed in the follower nut and through which the threaded bolt passes. This half thread arrangement includes a first half of the bore wall being formed with a thread which is engageable with a thread on the threaded bolt and a smooth wall formed on a diametrically opposite second half of the bore wall; and means permitting displacement of the nut follower along the first axis between a first position wherein engagement between the threads formed on the first half of the bore and the threads on the threaded bolt occurs and a second position wherein disengagement of the threads on the first half of the bore and the treads on the threaded bolt.

This displacement permitting means comprises the third bore having a non-circular cross section, and encompasses the situation wherein the first bore is a through bore so that pressure can be manually applied to first and second ends of the follower nut.

Also encompassed is the situation wherein the displacement permitting means comprises the third bore having a non-circular cross section, and wherein the first bore is a blind bore in which a spring is disposed so as to engage an inboard end of the follower nut and bias the follower nut toward the first position.

In addition to the above, blind bore configuration further comprises displacement inhibiting means for preventing the follower nut from being displaced away from its first position, the displacement inhibiting means comprising a flange formed at an outboard end of the follower nut and a pivotal member which can be interposed between the flange and the rocker arm to prevent movement of the nut follower toward its second position.

It is further with the scope of the third aspect of the invention that it is used with a table means for supporting a work piece, wherein the table means has first and second table portions which are operatively interconnected by drive means for selectively moving the first and second table portions toward and away from each other widen the table and increase a gap between the first and second table portions, and means defining a plurality of slots in the first and second table portions through which the lower end of the threaded bolt extends, a lower surface of each of the first and second table portions being the surface against which the stopper member reactively engages.

BRIEF DESCRIPTION OF THE DRAWINGS

The various features and attendant advantages of the present invention will become more apparent as a detailed description of the preferred embodiments is given with reference to the appended figures wherein.

DETAILED DESCRIPTION OF THE PREFERRED EMBODIMENTS

Figure 1:
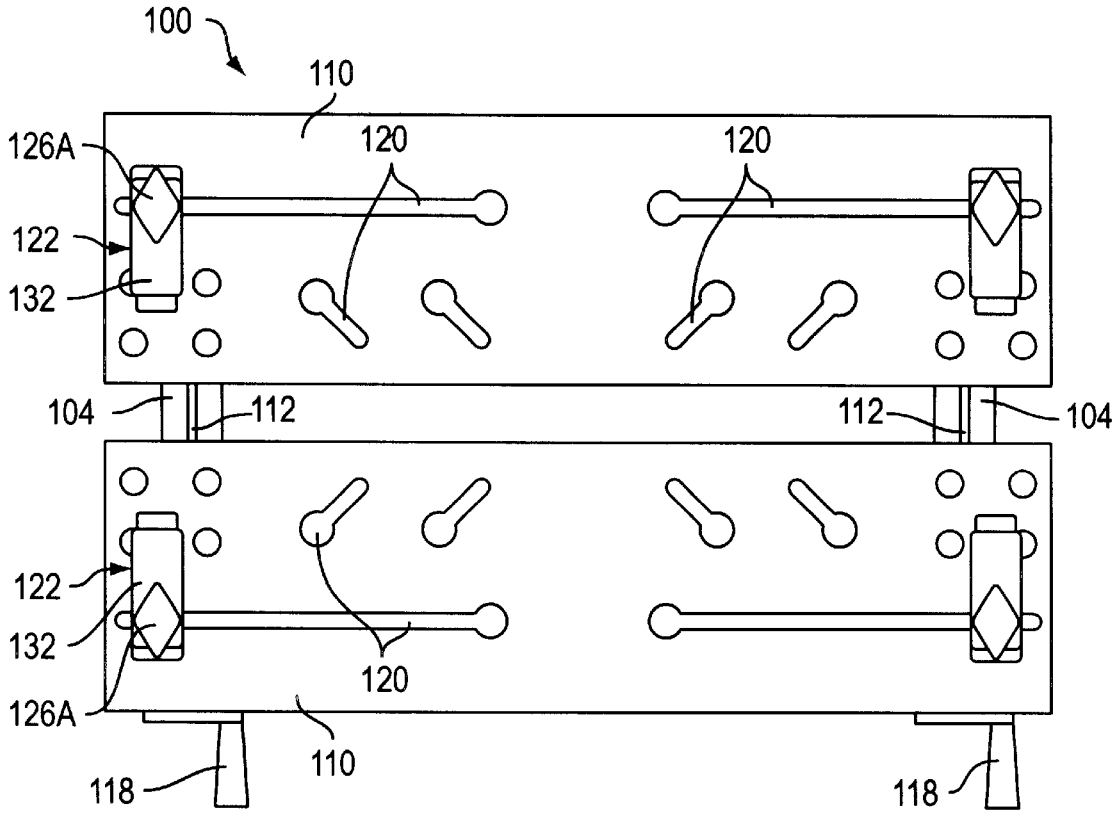
FIG. 1 is a top plan view of a workbench according to an embodiment of the present invention.

FIGS. 1–4 show a preferred embodiment of the workbench 100 according to the present invention. As shown, this arrangement comprises a trestle-like leg arrangement 102 wherein the legs of each pair are pivotally connected at the upper ends to a pair of cross members 104. In this embodiment, the pairs of legs at each end of the table are connected by a telescopically extendable brace member 106 and by a link 108 which, when the table is being folded, is arranged to induce one of each of the end pairs of legs to be moved vertically upward with respect to the other, and to cause the cross members 104, which bridge the upper ends of the legs, to become parallel with the other of the legs and to cause the table to fold into an essentially flat and compact arrangement suitable for storage.

Two bench boards or table sections 110, 110 are supported on the cross members 104 so that at least one is relatively moveable with respect to the other. That is to say, one or both of the bench boards 110, 110 are supported so as to be guidable along a guide track 112 which is formed in the upper surface of each of the cross members 104 via a support 114. In this embodiment, it is assumed that only one of the bench boards 110, 110 is operatively connected with a pair of rotatable drive shafts 116, 116 which are respectively journalled within the cross members 104 by way of a follower nut (not shown). Crank handles 118, 118, which are provided on the ends of the threaded drive shafts, are used to enable a user to selectively rotate the shafts and to induce relative movement between the bench boards. This of course allows a user to selectively adjust the width of the workbench, and/or to open up a suitable gap between the two bench boards 110, 110 as the situation demands.

Figure 2:
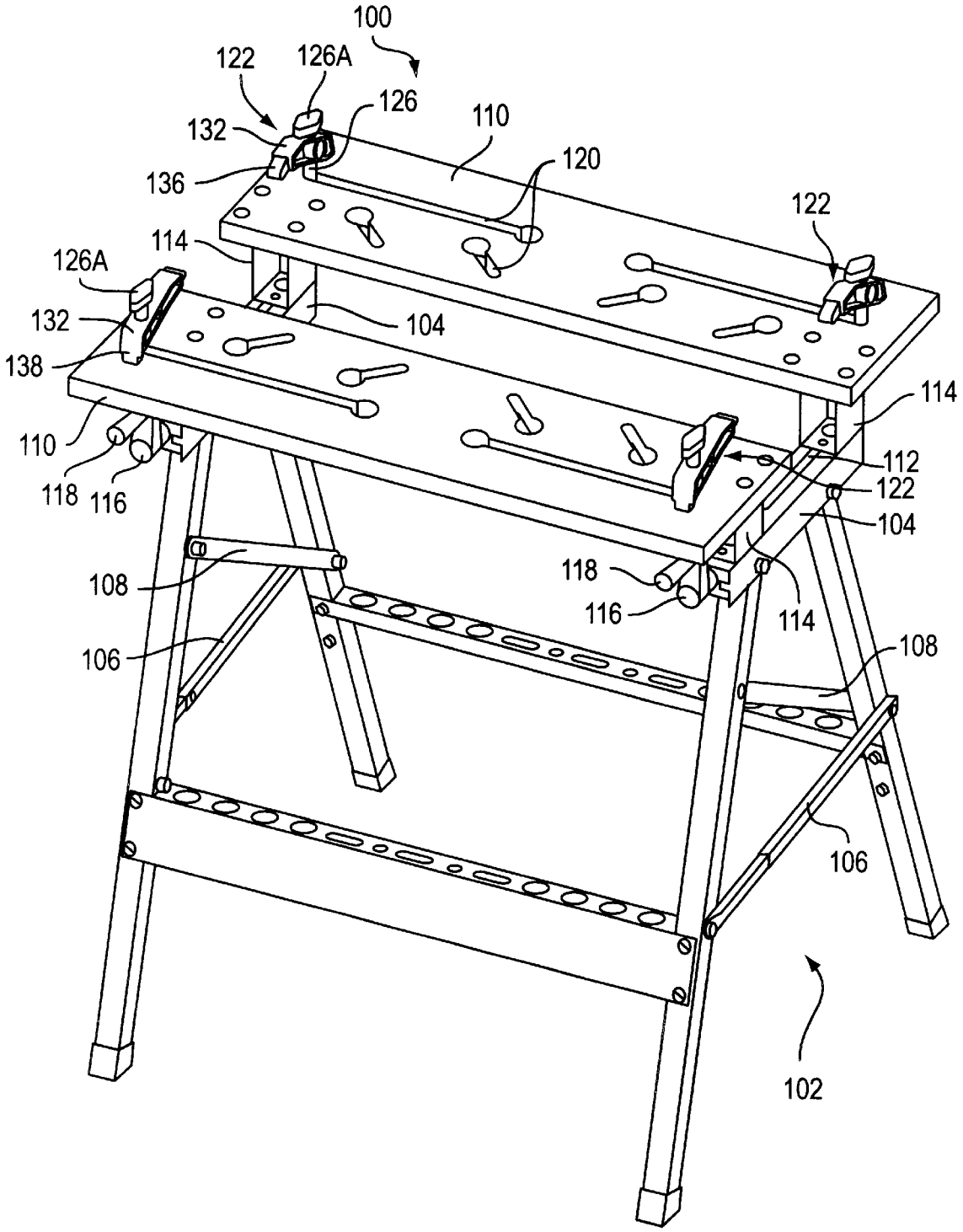
FIG. 2 is a perspective view of the workbench shown in FIG. 1.
Figure 3:
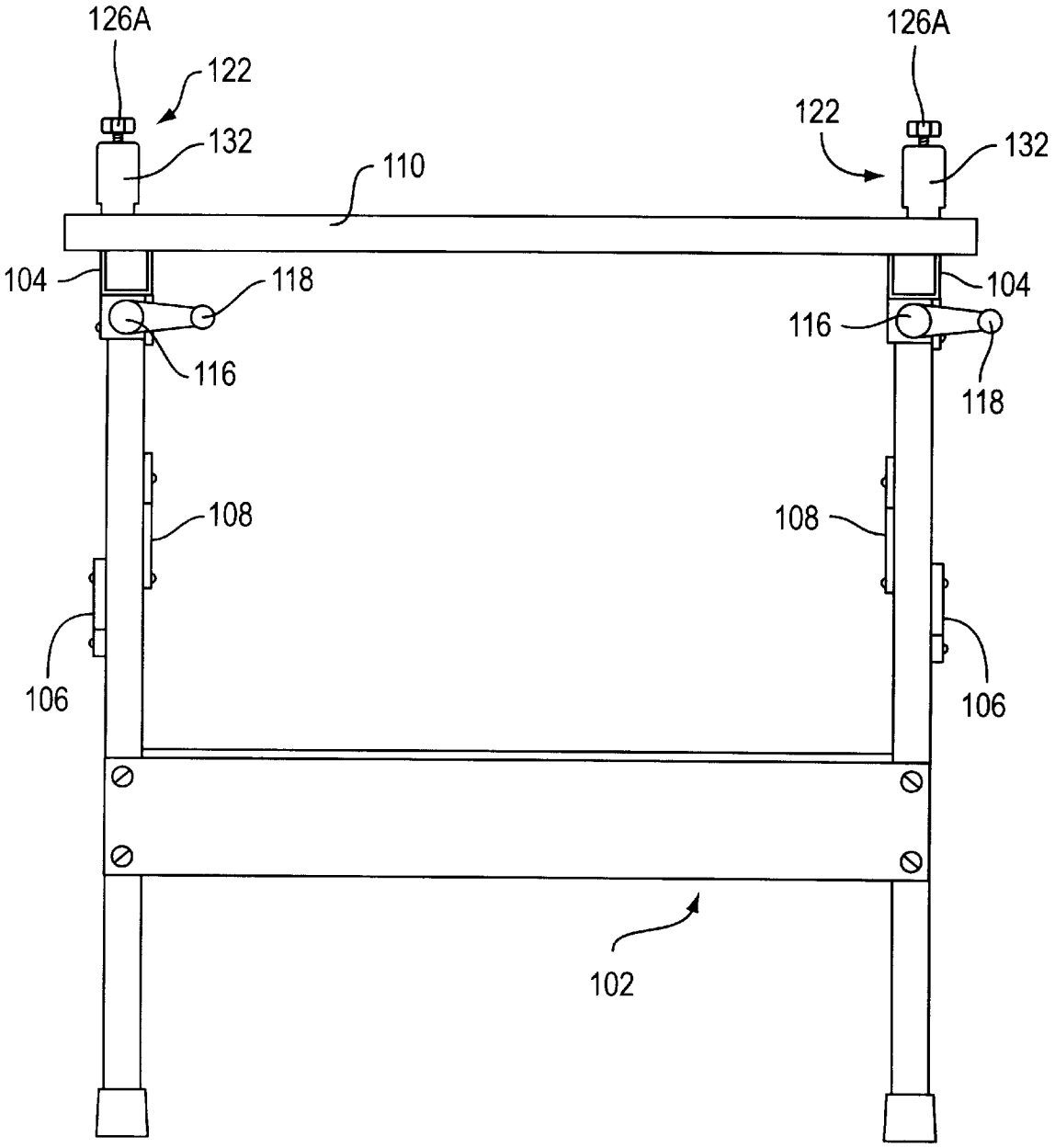
FIG. 3 is a side view of the workbench shown in FIGS. 1 and 2.
Figure 4:
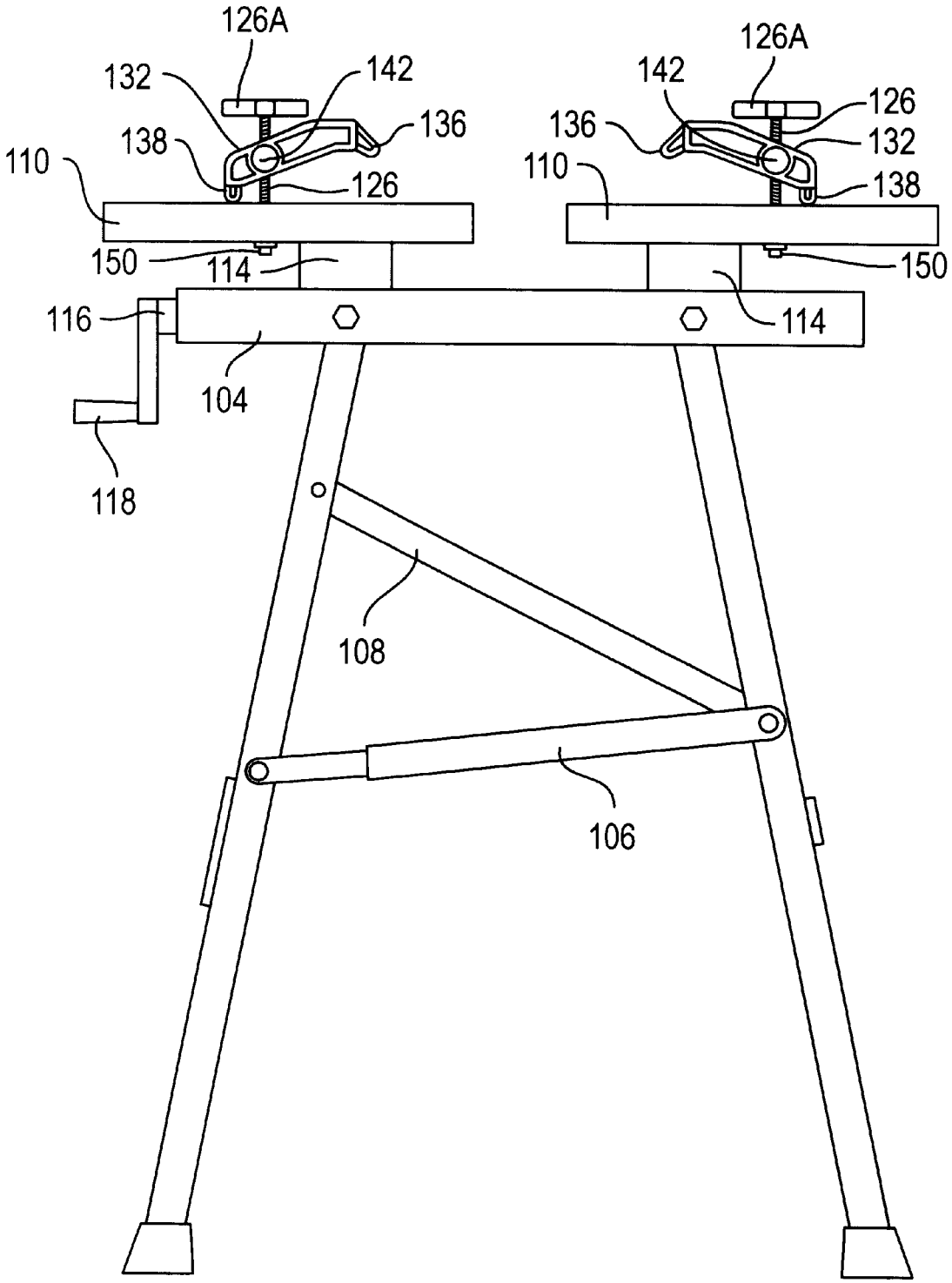
FIG. 4 is an end view of the workbench shown in FIGS. 1, 2, and 3.

As best seen in FIGS. 1 and 2, the bench boards 110, 110 are formed with a plurality of keyhole-like slots 120 which permit rocker arm clamps 122, as they will be referred to, to be selectively positioned about the top of the workbench 100 in accordance with the operators requirements. In this instance, the clamps 122 are arranged to be disposed through the circular opening at the end of each of the slots 120 and to be moved along the slot until the threaded shaft 126 (which will be disclosed in more detail herein later) is received in a narrower portion of a slot 120 so that a washer 128 and stopper 130 arrangement, which is provided at the bottom of the shaft 126, engages the lower surface of a bench board in which it is disposed. As will be immediately appreciated, the invention is not limited to the slot pattern which is illustrated in FIGS. 1 and 2, and that any other combination which is deemed desirable can be employed.

In the arrangement depicted in FIG. 2, four clamps 122 have been respectively disposed, in four of the elongated slots 120, and have been moved to the ends thereof so as to be proximate the ends of each of the bench boards 110. With this particular clamp disposition, it is possible to place a large piece of apparatus such as a saw bench (in the manner shown in FIG. 5), on top of the workbench 100 and to use the clamps 122 to engage the base flange B/F, which extends about the lower periphery of the body of the apparatus, and to secure it in position both quickly and easily.

It will be readily appreciated that the present invention is not limited to clamping pieces of apparatus to the top of the table and can easily be used to secure work pieces such as the piece of large diameter pipe. This can be accomplished by setting the gap between the two bench boards 110 to a distance which is less than the diameter of the pipe and, if necessary, setting wedge pieces against either side of the pipe and subsequently clamping the wedge pieces in position using the rocker arm clamps 122.

It is of course within the scope of the present invention to reinforce the sides of one or more of the slots 120 (in particular the longer ones) which are formed in the bench boards 110 using suitably dimensioned metal channel members or the like (not shown).

Figure 6:
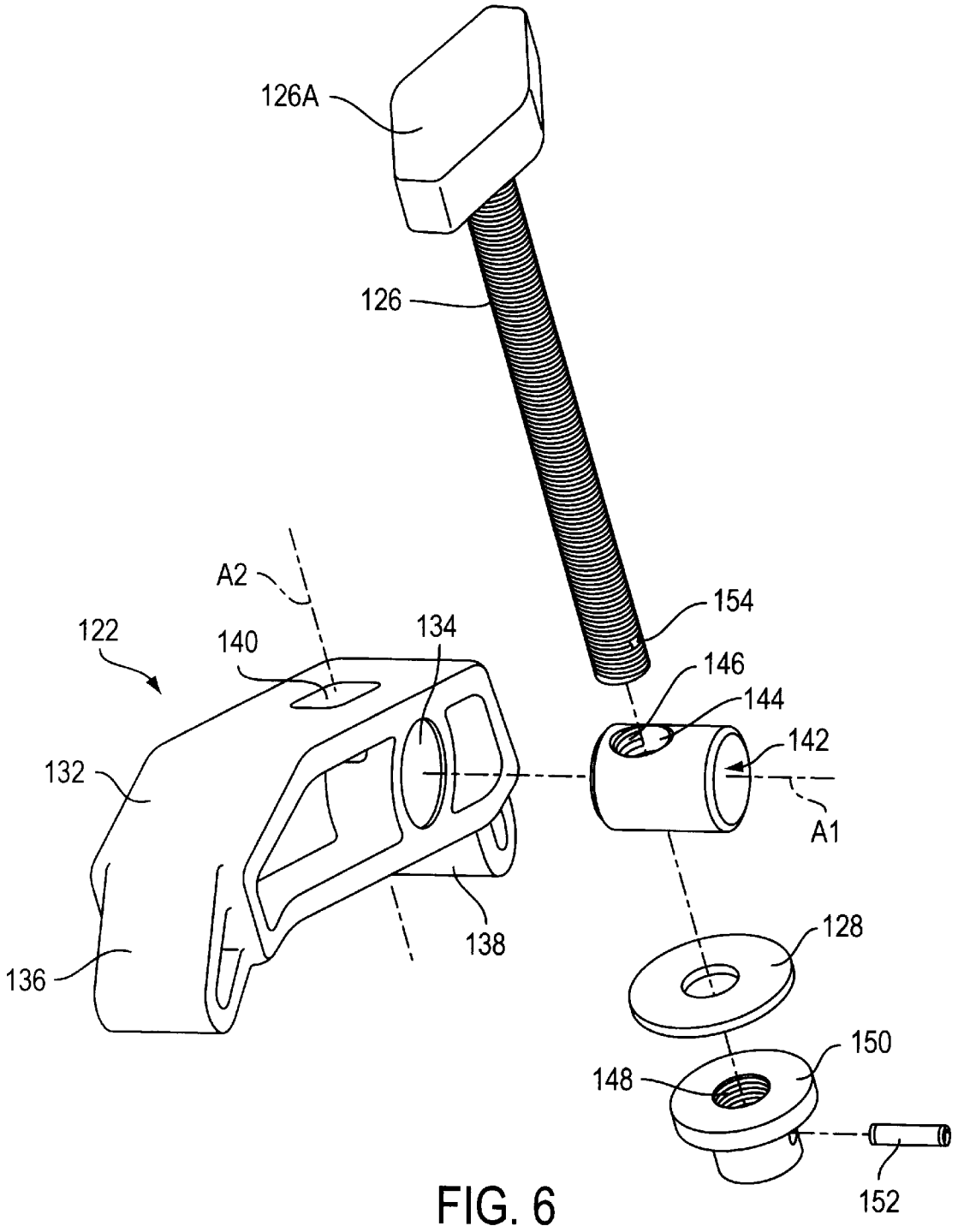
FIG. 6 is an exploded view showing the detailed construction of one of the rocker arm-type clamps.
Figure 7:
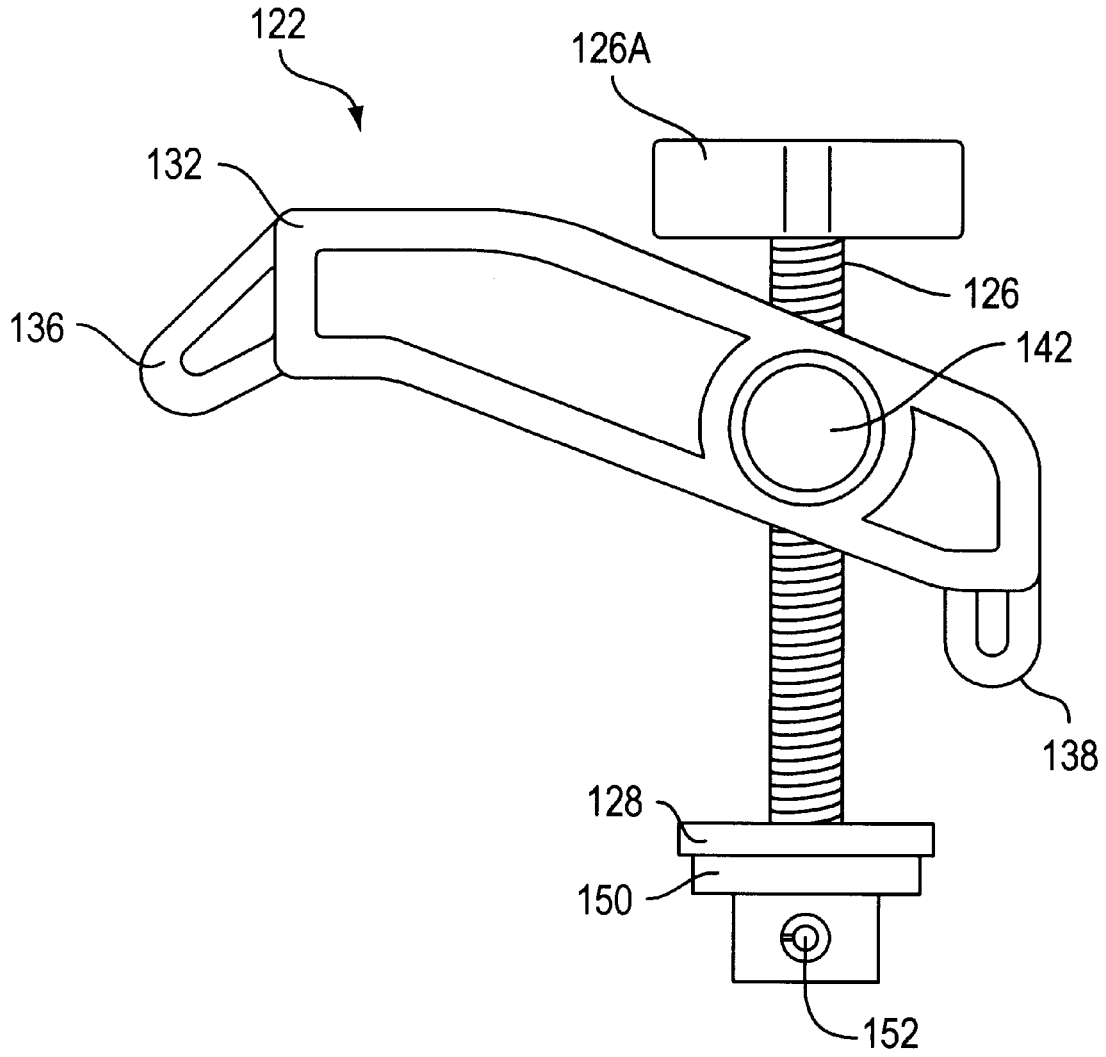
FIG. 7 is a side view showing a rocker arm-type clamp shown in FIG. 6, in a fully assembled condition.

FIGS. 6 and 7 show details of a first embodiment of a rocker arm clamp 122 which is used in accordance with the present invention. As will be seen, this device comprises what shall be referred to as a rocker arm 132 which is asymmetrically arranged about an axis A1 of rotation which passes through a circular bore 134 formed laterally through the arm 132 at a position which is closer to one end than the other. The engagement finger 136 which is formed on the longer portion of the rocker arm 132 is arranged to extend down at a predetermined angle (alpha) which is greater than the angle (beta) at which the engagement finger 138 which is formed on the shorter portion of the arm 132 is arranged to extend down therefrom. The threaded bolt 126 is arranged to extend through a vertically oriented bore 140 formed through the arm and which is such that its axis A2 intersects the axis A1 about which the rocker arm 122 is vertically pivotable. The arm 132 is of course pivotal in the horizontal direction about the axis A2.

A so-called "quick nut" 142 is separately disposed in the bore 134. This quick nut 142 is formed with a transverse bore 144 which is tapped in a manner wherein screw threads 146 are formed only on one side thereof. The bore 144 is slightly oblong so as to permit the quick nut 142 to be moved axially along the bore 134 so that the threads 146 which are formed in the bore can be moved out of engagement with the threads on the bolt 126 and thus permit the quick nut 142 to slide on the bolt 142 without the need for its rotation. When the quick nut 142 is slid back along the bore 134 in a direction which brings the tapped threads 146 in the bore 144 into engagement with the threads on the bolt 126, rotation on the bolt 126 via the knob member 126A, of course produces the normal screw thread drive which is associated with a conventional bolt and follower nut arrangement and permits the rocker arm 132 to be tightened down onto a piece of work or the like in a manner which clamps same in place.

As will be best appreciated from FIG. 6, the lower end of the bolt 126 is received in a tapped bore 148 that is formed in a clamp stabilizer or stopper 150. A roll pin 152 is disposed through the transverse bore 154 which is formed in the lower end of the bolt 126 and passes through the lower end of the clamp stabilizer 150 so as to prevent relative rotation between the stabilizer 150 and the bolt 126 during usage of the clamp. The washer 128 which is disposed about the bolt 126 is arranged to sit on top of a larger diameter portion of the clamp stabilizer 150. This washer 128, of course, is the member that actually engages the lower surface of a bench board 110.

Figure 5:
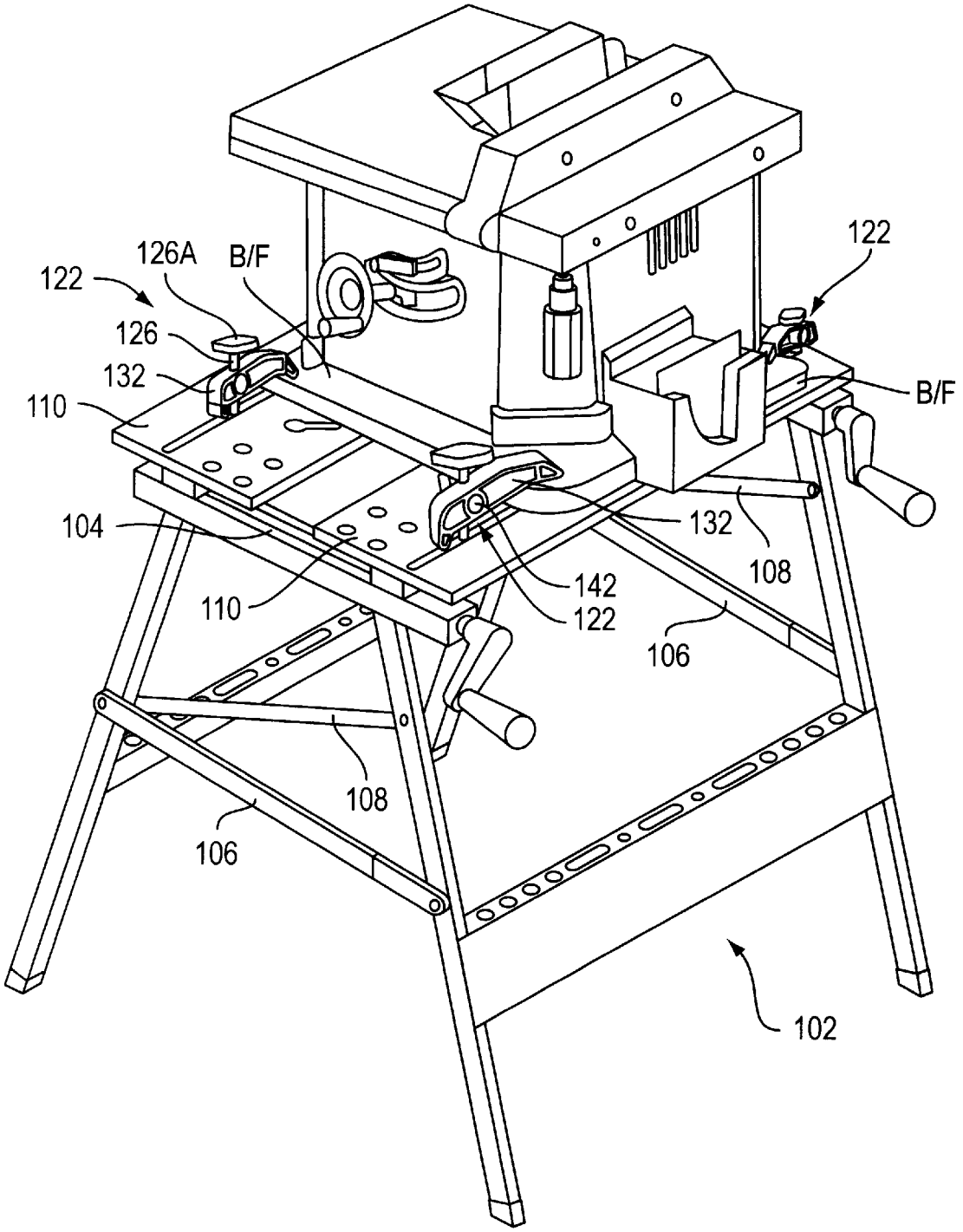
FIG. 5 is a perspective view showing a piece of apparatus securely clamped to the upper surface of the workbench using rocker arm clamps which form an important part of the invention.

The asymmetrical arrangement of the rocker arm allows the disposition such as shown in FIG. 5, wherein the engagement finger 138 formed on the shorter end of the rocker arm 132 engages the surface of the bench board 110 on which it is mounted, in a manner wherein a reaction which is produced causes the rocker arm 132 to pivot around the axis A1 and to drive the engagement finger 136 of the longer portion of the rocker arm 132, down into engagement with a surface of the object/work piece to be secured to the top of the workbench 100.

The operation of the quick nut arrangement 142 is such that manually applied pressure on one end of the nut 142 can be used to move it axially along the bore 134 formed in the rocker arm 132, to a position where disengagement between the threads on the bolt 126 and those formed in the quick nut 142, is achieved. Under these conditions, the rocker arm 132 can be quickly and easily positioned in the required manner, wherein the engagement finger 136 engages the work piece or the like, and the engagement finger 138 engages a surface of the bench board 110 over which it is disposed.

Pressing the quick nut 142 back to a position wherein engagement between the threads occurs allows the rotation of the bolt 126 to tighten the clamp 122 down on the work piece.

Figure 9:
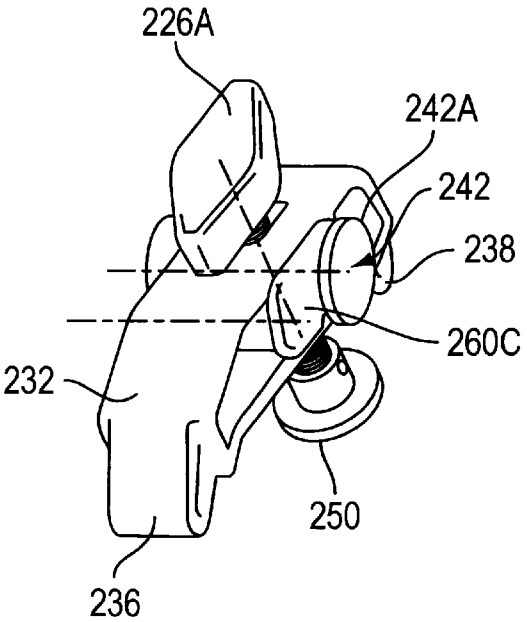
FIG. 9 is a perspective view showing the clamp depicted in FIG. 8, in a fully assembled condition.
Figure 8:
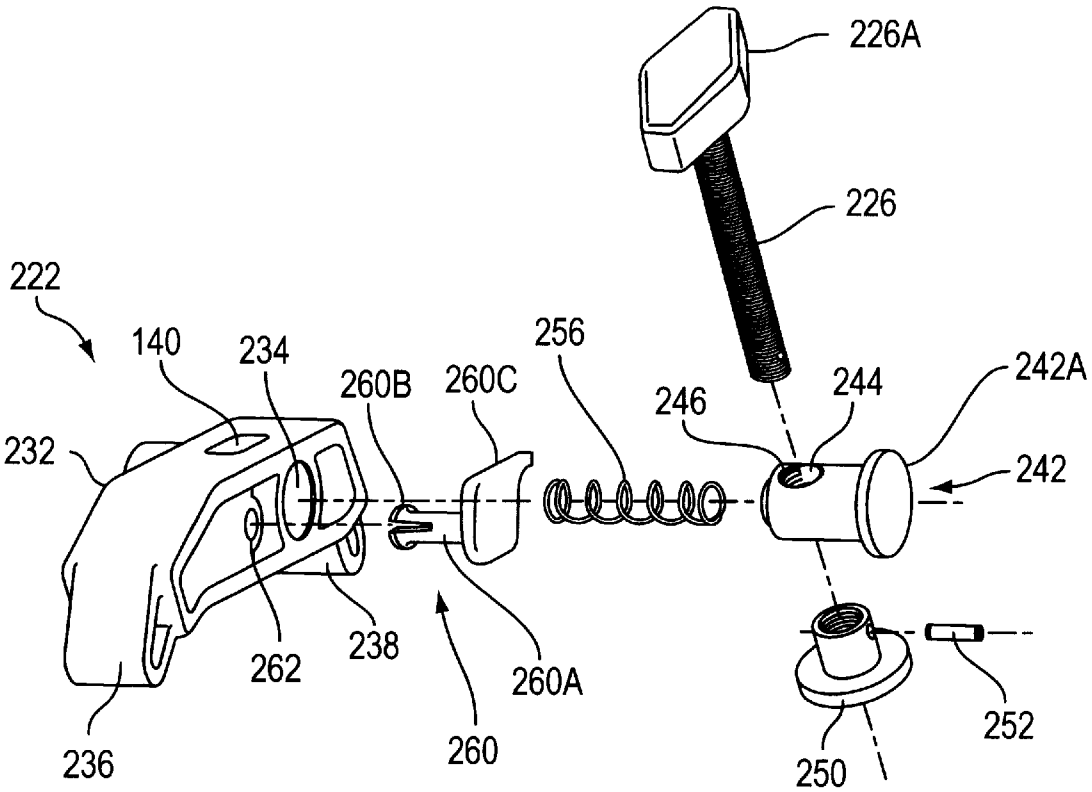
FIG. 8 is an exploded view showing the constructional details of a second embodiment of the rocker arm-type clamp which is used in accordance with the present invention.

FIGS. 8 and 9 shows a second embodiment of the rocker arm clamp 222 which can be used in accordance with the present invention. In this arrangement, the quick nut 242 is disposed in a blind bore 234. A spring 256 is disposed in the bore 243 between the inboard end of the quick nut 242 and the blind end of the bore. The nut 242 is formed with a flange 242A that limits the amount by which it can be forced into the bore 234 the bias of the spring 256. The distance between the inboard surface of the flange 242A and the threaded surface formed in the bore 244 is selected to permit an operator to press the exposed end of the quick nut 242 and to force it into the bore 234 by an amount sufficient to achieve disengagement between the bolt 226 and the threads 246 formed in the bore 244. When released, the quick nut 242 will, under the bias of the spring 256, move to a position wherein engagement between the bolt 226 and the threads 246 in the bore is re-established. Inasmuch as the bolt 226 passes through the quick nut per se, no further actual movement of the quick nut 242 under the influence of the spring 256 is permitted, once engagement between the threads has occurred.

This embodiment further features a quick nut lock arrangement 260. This arrangement comprises a molded member which can be disposed through a through bore 262 formed in the rocker arm 232 adjacent bore 234 so as to be pivotable about axis which is parallel to the axis about which the main body of the rocker arm 232 is pivotable. The shaft portion 260A of this lock arrangement which is received in the bore is formed with a split barbed end 260B which permits its insertion and self locking within the bore 262. A quick nut lock member 260C which is formed at the end of the shaft member 260A is arranged to be pivotable and to be arranged so that, as shown in FIG. 9, it can be swung to a position wherein an edge portion is interposed between the rocker arm 222 and the inboard surface of the flange 242A, thus securely preventing any inward axial motion of the quick nut 242. This of course insures that the quick nut 242 cannot be accidentally pressed and released or accidentally move under the influence of severe vibration. The remaining structural elements of this second embodiment will be essentially self-evident from the preceding disclosure and will not discussed in detail for the sake of brevity. It will be pointed out that in this case the so called clamp stabilizer 250 is inverted with respect to that used in the first embodiment, and is such that the narrow diameter portion thereof can fit in the slot 120 while the larger diameter portion engages the lower surface of a bench board 10. The stabilizer 250 is of course pinned to the end of the threaded bolt.

The operation and use of this second embodiment of the rocker arm clamp is essentially identical to the first, and therefore no further description of its use and operation is deemed necessary for a person of skill in the art to which this invention pertains.

Although the present invention has been described with reference to only a limited number of embodiments, the various changes and modifications which can be made without departing from the scope of the invention which is limited only by the appended claims, will be immediately self-evident to those skilled in the art to which the present invention pertains.

What is claimed is:

1. An apparatus comprising:

a clamp, said clamp comprising:

a body having first and second ends and first and second engagement portions formed respectively at the first and second ends, the first engagement portion being angled with respect to a longitudinal axis of said body at a first angle and the second engagement portion being angled with respect to the longitudinal axis at a second angle which is different from the first angle;

first bore formed through said body portion, said bore being formed so as to be located so as to be closer to the first end of the body than the second end, said first bore having a first axis;

a second bore formed through the body, said second bore being formed so as to intersect said first bore;

a threaded bolt disposed through said second bore;

a cylindrical nut disposed in said first bore, said cylindrical nut having a third bore formed therein through which said threaded bolt extends, said bore having a half thread formed on a first portion of its inner periphery and a smooth surface on a second diametrically opposite inner peripheral portion, said bore having a non-circular cross section so as to be oblong in the direction of said first axis, said cylindrical nut being axially displaceable in said first bore so as to be moved between a first position wherein engagement between the half thread formed on the first portion of the inner periphery of said third bore and a thread on said threaded bolt, engage, and a second position wherein the half thread formed in said third bore and the thread on said threaded bolt disengage; and a stopper member fastened to the bottom of said threaded bolt.

2. An apparatus as set forth in claim 1, wherein said first bore is a through bore and said cylindrical nut has first and second end surfaces which are exposed at the ends of said first bore so that the cylindrical nut can be manually displaced between said first and second positions.

3. An apparatus as set forth in claim 1, wherein said first bore is a blind bore and wherein said cylindrical nut has first and second ends, wherein a biasing means is disposed in the blind bore in a manner to engage a first end of said cylindrical nut and to bias the nut toward said first position, said cylindrical nut further comprising a flange at the second end thereof, the flange having a diameter larger than a diameter of said first bore and an inner side wall which engages a side of said body, the distance from the inner wall to said half threads being selected such that when said cylindrical nut is manually displaced into said first bore against the bias of the biasing means, the inner wall of the flange engages the side of the body only after the half threads in the third bore have disengaged from the threads on said threaded bolt.

4. An apparatus as set forth in claim 3, further comprising a locking means for locking said cylindrical nut in its first position, said locking means comprising a pivotal member which can be interposed between the body and the flange and to engage the inner wall of the flange so that movement of said cylindrical nut into said first bore is prevented and the cylindrical nut is maintained in its first position.

5. An apparatus as set forth in claim 1, further comprising a table, said table having at least a first slot formed therein, the first slot having a width which is less than the stopper, said threaded bolt being disposed through said slot so that said stopper member engages a lower surface of said table, and the body is located above an upper surface of said table and so that one of the first and second engagement portions is engageable with the upper surface of the table.

6. An apparatus as set forth in claim 5, wherein said slot has an enlarged portion having a width greater than that of said stopper member and through which said stopper member can be inserted.

7. An apparatus as set forth in claim 6, wherein the enlarged portion is formed at the end of the slot to form a keyhole-shaped configuration.

8. An apparatus as set forth in claim 5, wherein said table is formed in first and second table portions, said first and second table portions being supported on a support structure, the first table portion being arranged to be movable with respect to the support structure and the second table portions and operatively connected with a drive mechanism to be selectively movable with respect to the second table portion.

9. An apparatus as set forth in claim 8, wherein the second table portion is formed with at least a second slot which has a width which is less than that of said stopper member and which has an enlarged portion which has a width which is larger than said stopper portion and through which the stopper and be disposed.

10. An apparatus as set forth in claim 9, wherein the enlarged portion is formed at the end of the slot to form a keyhole-shaped configuration.

11. An apparatus as set forth in claim 8, wherein the support structure has two pairs of legs, each leg of each pair of legs being pivotally connected to a cross member, each pair of legs being interconnected by a pair of braces respectively, each of the pair of braces being pivotally connected at a first end to a first of the pair of legs at a first distance from the point at which the first leg is connected to a cross member, and pivotally connected at a second end to a second of the pair of legs at a second distance from the point at which the second leg is connected to the cross member, the second distance being greater than the first distance.

12. An apparatus as set forth in claim 11, wherein said support structure further has pair of second telescopic braces which respectively interconnect each pair of legs and which can be selectively locked in an extended condition.

13. An apparatus as set forth in claim 8, wherein the drive mechanism comprises a threaded shaft which is rotatably journalled on a cross member and which is operatively connected to the first table portion by a threaded follower which is rigidly connected to the first table portion.

14. An apparatus as set forth in claim 13, wherein the threaded shaft has a manually operable crank handle at one end.

15. An apparatus as set forth in claim 8, wherein the drive mechanism comprises a pair of threaded shafts which are each rotatably journalled on a cross member and which are operatively connected to the first table portion by a threaded follower which is rigidly connected to the first table portion.

16. An apparatus as set forth in claim 15, wherein each of the pair of threaded shafts has a manually operable crank handle at one end.

17. An apparatus comprising:

a table supported on a support structure, said table comprising first and second table portions which are operatively interconnected by a drive mechanism so as to be movable relative to each other, each of the table portions being formed with a plurality of keyhole-shaped slots which slots each extend from an upper surface to a lower surface of each of the table portions and which each have an elongate narrow horizontally extending portion and a wide portion at one end so as to have a keyhole-shaped configuration; and a plurality of clamp members, each of said clamp members having a stopper member at a lower end thereof, and which can be disposed through a wide portion of a slot and moved to a narrow portion so that the stopper member is engageable with a lower surface of the table portion in which the slot is formed, so that the clamp is restrained against vertical displacement.

18. An apparatus comprising:

a table supported on a support structure, said table comprising first and second table portions which are operatively interconnected by a drive mechanism so as to be movable relative to each other, each of the table portions being formed with a plurality of keyhole-shaped slots which extend having an elongate narrow portion and a wide portion at one end; and a plurality of clamp members, each of said clamp members having a stopper member at a lower end thereof, and which can be disposed through a wide portion of a slot and moved to a narrow portion so that the stopper member is engageable with a lower surface of the table portion in which the slot is formed, so that the clamp is restrained against vertical displacement;

wherein each of the clamps comprises:

a threaded bolt which has a lower end rigidly connected to a stopper member;

a body having first and second ends on which first and second engagement portions are respectively formed, the first engagement portion being angled with respect to a longitudinal axis of said body at a first angle and the second engagement portion being angled with respect to the longitudinal axis at a second angle which is different from the first angle;

a first bore formed through said body portion, said bore being formed so as to be located so as to be closer to the first end of the body than the second end, said first bore having a first axis;

a second bore formed through the body, said second bore being formed so as to normally intersect said first bore;

a threaded bolt disposed through said second bore, the stopper member being rigidly connected to a lower end of said threaded bolt; and a cylindrical nut disposed in said first bore, said cylindrical nut having a third bore formed therein through which said threaded bolt extends, said bore having a thread formed on one side and a smooth surface on a second diametrically opposite side, said bore having a non-circular cross section so as to be oblong in the direction of said first axis, said cylindrical nut being axially movable in said first bore so as to be moved between a first position wherein engagement between the thread formed in said third bore and a thread on said threaded bolt engage and a second position wherein the thread formed in said third bore and the thread on said threaded bolt disengage.

19. An apparatus as set forth in claim 18, wherein said first bore is a through bore and said cylindrical nut has first and second end surfaces which are exposed at the ends of said first bore so that the cylindrical nut can be manually displaced between said first and second positions.

20. An apparatus as set forth in claim 18, wherein said first bore is a blind bore and wherein said cylindrical nut has first and second ends, wherein a biasing means is disposed in the blind bore in a manner to engage a first end of said cylindrical nut and to bias the nut toward said first position, said cylindrical nut further comprising a flange at the second end thereof, the flange having a diameter larger than a diameter of said first bore and an inner side wall which engages a side of said body, the distance from the inner wall to said half threads being selected such that when said cylindrical nut is manually displaced into said first bore against the bias of the biasing means, the inner wall of the flange engages the side of the body only after the half threads in the third bore have disengaged from the threads on said threaded bolt.

21. An apparatus as set forth in claim 20, further comprising a locking means for locking said cylindrical nut in its first position, said locking means comprising a pivotal member which can be interposed between the body and the flange and to engage the inner wall of the flange so that movement of said cylindrical nut into said first bore is prevented and the cylindrical nut is maintained in its first position.

22. An apparatus as set forth in claim 20, wherein the support structure has two pairs of legs, each leg of each pair of legs being pivotally connected to a cross member, each pair of legs being interconnected by a pair of braces respectively, each of the pair of braces being pivotally connected at a first end to a first of the pair of legs at a first distance from the point at which the first leg is connected to a cross member, and pivotally connected at a second end to a second of the pair of legs at a second distance from the point at which the second leg is connected to the cross member, the second distance being greater than the first distance.

23. An apparatus as set forth in claim 22, wherein said support structure further has pair of second telescopic braces which respectively interconnect each pair of legs and which can be selectively locked in an extended condition.

24. An apparatus as set forth in claim 22, wherein the drive mechanism comprises a threaded shaft which is rotatably journalled on a cross member and which is operatively connected to the first table portion by a threaded follower which is rigidly connected to the first table portion.

25. An apparatus as set forth in claim 22, wherein the threaded shaft has a manually operable crank handle at one end.

26. An apparatus as set forth in claim 22, wherein the drive mechanism comprises a pair of threaded shafts which are each rotatably journalled on a cross member and which are operatively connected to the first table portion by a threaded follower which is rigidly connected to the first table portion.

27. An apparatus as set forth in claim 26, wherein each of the pair of threaded shafts has a manually operable crank handle at one end.

28. An apparatus comprising:

a rocker arm respectively pivotal about a laterally extending axis which is coincident with an axis of a first bore which is extends laterally through said rocker arm, and a vertically extending axis which is coincident with an axis of a second bore which extends vertically through said rocker arm, first and second ends of said rocker arm respectively having first and second engagement portions adapted to respectively engage first and second surfaces; and means for producing a force which forces the first and second engagement portions into engagement with the first and second surfaces.

29. An apparatus as set forth in claim 28, wherein said force producing means comprises:

a threaded bolt and a nut follower, the nut follower being disposed in said first bore and said threaded bolt being disposed through said second bore; and quick release means for temporarily disengaging a drive connection between the threaded bolt and the nut follow and for allowing the rocker arm to be freely moved along the threaded bolt and to be rotated about the first and second axes to quickly achieve a desired disposition of the first and second engagement portions on first and second surfaces.

30. An apparatus as set forth in claim 29, wherein the force producing means further comprises a stopper member which is rigidly connected to a lower end of the threaded bolt and which is adapted to engage a surface and to produce a reaction which causes the rocker arm to be drawn theretoward when the nut follower is in the first position and the threaded bolt is rotated in a direction which moves the nut follower along the threaded bolt toward the stopper member.

31. An apparatus as set forth in claim 29, wherein the quick release means comprises:

a half thread arrangement formed in a third bore which is formed in the follower nut and through which the threaded bolt passes, said half thread arrangement comprising a first half of the bore wall being formed with a thread which is engageable with a thread on the threaded bolt and a smooth wall formed on a diametrically opposite second half of the bore wall;

and means permitting displacement of the nut follower along the first axis between a first position wherein engagement between the threads formed on the first half of the bore and the threads on the threaded bolt occurs and a second position wherein disengagement of the threads on the first half of the bore and the treads on the threaded bolt.

32. An apparatus as set forth in claim 30, further comprising table means for supporting a work piece, said table means having first and second table portions which are operatively interconnected by drive means for selectively moving the first and second table portions toward and away from each other widen the table and increase a gap between the first and second table portions, and means defining a plurality of slots in said first and second table portions through which the lower end of said threaded bolt extends, a lower surface of each of said the first and second table portions being the surface against which said stopper member reactively engages.

33. An apparatus as set forth in claim 28, wherein said displacement permitting means comprises said third bore having a non-circular cross section, and wherein said first bore is a through bore so that pressure can be manually applied to first and second ends of said follower nut.

34. An apparatus as set forth in claim 28, wherein said displacement permitting means comprises said third bore having a non-circular cross section, and wherein said first bore is a blind bore in which a spring is disposed so as to engage an inboard end of the follower nut and bias the follower nut toward the first position.

35. An apparatus as set forth in claim 34, further comprising displacement inhibiting means for preventing the follower nut from being displaced away from its first position, said displacement inhibiting means comprising a flange formed at an outboard end of the follower nut and a pivotal member which can be interposed between the flange and the rocker arm to prevent movement of the nut follower toward its second position.

36. An apparatus, comprising:

a support structure;

a table mounted on said support structure, said table having a first and a second table portion, said first table portion being arranged to be movable with respect to said support structure and said second table portion and operatively connected with a drive mechanism to be selectively movable with respect to the second table portion, said first table portion having at least a first slot formed therein, said at least first slot extending vertically through the first table portion and opening on both upper and lower sides of the first table portion and having an enlarged portion formed at one end of said at least first slot to form a horizontally extending keyhole-shaped configuration.

37. An apparatus as set forth in claim 36 wherein said second table portion has at least a second slot formed therein, said at least second slot extending vertically through the second table portion and opening on both upper and lower sides of the second table portion and having an enlarged portion formed at one end of said at least second slot to form a horizontally extending keyhole-shaped configuration.

38. An apparatus as set forth in claim 37, wherein said at least second slot is capable of receiving a clamp means.

39. An apparatus as set forth in claim 36, wherein said support structure comprises two pairs of legs, each leg of each pair of legs being pivotally connected to a cross member, each pair of legs being interconnected by a pair of braces respectively, each of the pair of braces being pivotally connected at a first end to a first of the pair of legs at a first distance from the point at which the first leg is connected to a cross member, and pivotally connected at a second end to a second of the pair of legs at a second distance from the point at which the second leg is connected to the cross member, the second distance being greater than the first distance.

40. An apparatus as set forth in claim 39, wherein said support structure further comprises a pair of second braces which respectively interconnect each pair of legs and which can be selectively locked in an extended condition.

41. An apparatus as set forth in claim 36, wherein said drive mechanism comprises a threaded shaft which is rotatably journalled on a cross member and which is operatively connected to said first table portion by a threaded follower which is rigidly connected to said first table portion.

42. An apparatus as set forth in claim 41, wherein said threaded shaft has a manually operable crank handle at one end.

43. An apparatus as set forth in claim 36, wherein said drive mechanism comprises a pair of threaded shafts which are each rotatably journalled on a cross member and which are operatively connected to said first table portion by a threaded follower which is rigidly connected to said first table portion.

44. An apparatus as set forth in claim 43, wherein each of said pair of threaded shafts has a manually operable crank handle at one end.

45. An apparatus as set forth in claim 36, wherein said at least first slot is capable of receiving a clamp means.

46. An apparatus as set forth in claim 45 or 38, wherein said clamp means comprises:

a body having first and second ends and first and second engagement portions formed respectively at the first and second ends, the first engagement portion being angled with respect to a longitudinal axis of said body at a first angle and the second engagement portion being angled with respect to the longitudinal axis at a second angle which is different from the first angle;

a first bore formed transversely through said body portion, said bore being formed so as to be located so as to be closer to the first end of the body than the second end, said first bore having a first axis;

a second bore formed vertically through the body, said second bore being formed so as to intersect said first bore;

a threaded bolt disposed through said second bore;

a cylindrical nut disposed in said first bore, said cylindrical nut having a third bore formed therein through which said threaded bolt extends, said bore having a half thread formed on a first portion of its inner periphery and a smooth surface on a second diametrically opposite inner peripheral portion, said bore having a non-circular cross section so as to be oblong in the direction of said first axis, said cylindrical nut being axially displaceable in said first bore so as to be moved between a first position wherein engagement between the half thread formed on the first portion of the inner periphery of said third bore and a thread on said threaded bolt, engage, and a second position wherein the half thread formed in said third bore and the thread on said threaded bolt disengage; and, a stopper member fastened to the bottom of said threaded bolt.

47. An apparatus as set forth in claim 46, wherein said first bore is a through bore and said cylindrical nut has first and second end surfaces which are exposed at the ends of said first bore so that the cylindrical nut can be manually displaced between said first and second positions.

48. An apparatus as set forth in claim 46, wherein said first bore is a blind bore and wherein said cylindrical nut has first and second ends, wherein a biasing means is disposed in the blind bore in a manner to engage a first end of said cylindrical nut and to bias the nut toward said first position, said cylindrical nut further comprising a flange at the second end thereof, the flange having a diameter larger than a diameter of said first bore and an inner side wall which engages a side of said body, the distance from the inner wall to said half threads being selected such that when said cylindrical nut is manually displaced into said first bore against the bias of the biasing means, the inner wall of the flange engages the side of the body only after the half threads in the third bore have disengaged from the threads on said threaded bolt.

49. An apparatus as set forth in claim 48, further comprising a locking means for locking said cylindrical nut in its first position, said locking means comprising a pivotal member which can be interposed between the body and the flange and to engage the inner wall of the flange so that movement of said cylindrical nut into said first bore is prevented and the cylindrical nut is maintained in its first position.

* * * * *